US005353985A

United States Patent [19]

Nägeli et al.

[11] Patent Number: 5,353,985

[45] Date of Patent: Oct. 11, 1994

[54] PACKAGE

[75] Inventors: Hans-Rudolf Nägeli, Neuhausen; Hans Schindler, Schaffhausen; Heinz Oster, Feuerthalen, all of Switzerland

[73] Assignee: Alusuisse-Lonza Services Ltd., Zurich, Switzerland

[21] Appl. No.: 822,633

[22] Filed: Jan. 17, 1992

[30] Foreign Application Priority Data

Feb. 4, 1991 [CH] Switzerland ..... 332/91

[51] Int. Cl.[5] ..... B65D 43/02

[52] U.S. Cl. ..... 229/123.1; 229/120.03; 229/204; 220/524

[58] Field of Search ..... 229/120.03, 123.1, 123.2, 229/125.35, 125.33, 125.34, 204; 220/526, 524, 260, 528; 383/210

[56] References Cited

U.S. PATENT DOCUMENTS

| | | | |
|---|---|---|---|
| Re. 31,571 | 5/1984 | Mann | 229/123.2 |
| 3,120,336 | 2/1964 | Whatley, Jr. | 383/210 |
| 3,123,210 | 3/1964 | Hermanson et al. | 383/210 X |
| 3,158,491 | 11/1964 | Farrell et al. | 229/123.2 |
| 3,159,303 | 12/1964 | Betner | 229/123.2 |
| 3,298,593 | 1/1967 | Stephenson | 229/123.2 |
| 3,547,338 | 12/1970 | Hemmes | 229/123.1 |
| 3,633,785 | 1/1972 | Cyr et al. | 220/526 |
| 3,734,388 | 5/1973 | Hopkins | 383/210 |
| 3,854,653 | 12/1974 | Engelsberger | 383/210 |
| 4,469,258 | 9/1984 | Wright et al. | 229/123.1 |
| 4,903,842 | 2/1990 | Tokuda et al. | 229/123.1 |
| 4,966,296 | 10/1990 | Farrell | 229/120.11 |
| 5,022,551 | 6/1991 | Hexel | 220/359 |
| 5,042,681 | 8/1991 | Bolte et al. | 229/120.03 |
| 5,094,355 | 3/1992 | Clark et al. | 220/526 |

FOREIGN PATENT DOCUMENTS

| | | | |
|---|---|---|---|
| 0001094 | 3/1979 | European Pat. Off. | 229/123.1 |

*Primary Examiner*—Allan N. Shoap
*Assistant Examiner*—Christopher McDonald
*Attorney, Agent, or Firm*—Bachman & LaPointe

[57] ABSTRACT

Round or oval package, containing a bottom portion with one or more compartments and a peel-off lid mounted on the edges of the compartment or compartments, wherein the lid is divided into lid segments, wherein each lid segment covers a compartment and each lid segment is sealed onto the bottom portion along the circumference of the compartment and each lid segment contains an initial tearing aid and each lid segment can be partially or completely peeled or pulled off by the seal seam along the circumference of the compartment. The package is sterilizable and the sides of the bottom portion and of the lid facing towards the inside of the container comprise a polyolefin or polyester layer.

17 Claims, 6 Drawing Sheets

PACKAGE

The present invention concerns a package, containing a bottom portion with one or more compartments and a peel-off lid mounted on the edge of the compartment or compartments, wherein the lid is divided into lid segments, wherein each lid segment covers a compartment and each lid segment is sealed onto the bottom portion along the circumference of the compartment and each lid segment can be partially or completely peeled or pulled off by the seal seam along the circumference of the compartment.

Packages of this kind are known e.g. as set meal trays, and provided for holding food compilations. The individual compartments can be filled with different filler materials, then closed with a lid and e.g. sterilized. Usually the lid is sealed onto plane surfaces provided therefor at the upper outer edge and any existing dividing webs. Thus all the filler material is sealed off from the outside and the different filler materials in the different compartments are also separated from each other in mutually sealing relationship.

Such package units, if they comprise two or more chambers, are also known as multi-compartment trays.

EP 0 386 416 for example describes an easy-to-open package with a sealed-on lid portion and a lower portion, wherein in the lid portion a tear-open region is defined by a weak line. These weak lines are located on the lid material in each case within the seal seams. During the opening process, therefore, the seal seams remain intact, and the lid material begins to tear along the weak lines and exposes the contents. This arrangement has the disadvantage that due to lid material remaining along the edge flanges of the lower portion, ugly presentation forms arise and in certain circumstances a compartment can be emptied only incompletely. Further, weak lines tend not to begin to tear, and the tear line continues in an undesirable manner not along the weak line, but uncontrolled across the lid material.

From German patent application 26 45 922 is known a package the lower portion of which is made of a PVC-PE film and the upper portion of which is made of a combination of transparent cellulose film and PE with a polyvinylidene chloride coating, wherein the package is round as an example and divided into two compartments.

If round bottom portions with corresponding sealed-on round lids are chosen, even if there is a tear-open strip, the lid can be opened only with unduly great effort. This is particularly so if the materials and the joint between bottom portion and lid have to withstand the sterilizing conditions. In certain circumstances this also results in a set meal tray slipping away from the consumer, which can have unforeseeable consequences. If the material of the bottom portion is thin, e.g. in case of so-called unstable or semi-rigid containers, the container can collapse or fold in the middle when the lid is torn open. Here too, the annoying consequences to the user are foreseeable.

It is the object of the present invention to propose a package which does not have the above disadvantages and in particular allows sterilizing treatment and subsequently permits easy opening of a sealed-on lid.

According to the invention this is achieved by the fact that the package in plan view has a round or oval shape, that each lid segment contains an initial tearing aid, that the package is sterilizable and that the bottom portion and the lid comprise a polyolefin or polyester layer at least on the side facing towards the inside of the container.

Containers of this kind may contain for example a bottom portion in tray or cup form.

The bottom portions can be divided into compartments of any number and shape within the tray or cup form. The division within the container can be made by integrally molded or inserted webs. The webs can be made by, for example, deep drawing, molding, injection molding or folding in a single operation during manufacture of the bottom or by glueing them into the bottom portion subsequently. The webs can be arranged for example in a T-shape or Y-shape to form a three-compartment container.

Bottom portions with 2 to 12 compartments are preferred, containers with 2 to 4 compartments are particularly preferred, and as a rule the containers comprise 2 or 3 compartments.

The diameter or the maximum width and length is uncritical in itself, and is normally 8–30 cm. The height of such bottom portions is governed by practical requirements and can be 1–20 cm, for example. Bottom portions with an average diameter of 16–20 cm and 2–5 cm high are preferred. The external dimensions are appropriately also governed by circumstances such as standards and standard sizes, for example in the case of food packages the utensil sizes which are made use of for further processing.

The bottom portions and lids can, according to their purpose, the desired strength and the selected type of shaping, be manufactured with the aid of various materials such as for example plastics, natural and artificial cellulosic materials, metal or combinations, mixtures or laminates thereof.

Such materials are known in the art, and the plastics may be for example thermoplastic polymers based on acetal, acrylic resin, amide, arylene sulphide, arylene sulphone, arylene carbonate, carbonate, cellulose, ester, imide, olefin, styrene and vinyl halide or suitable mixtures thereof.

The bottom portions and lids comprise a polyolefin or polyester layer on the side facing towards the inside of the container.

As examples there may be mentioned polyolefins such as polyethylene, such as high-density polyethylene (HDPE, density greater than 0.944 g/cm$^3$), medium-density polyethylene (MDPE, density 0.926–0.940 g/cm$^3$), linear medium-density polyethylene (LMDPE, density 0.926–0.940 g/cm$^3$), low-density polyethylene (LDPE, density 0.910–0.925 g/cm$^3$) and linear low-density polyethylene (LLDPE, density 0.916–0.925 g/cm$^3$), polypropylene, poly-1-butene, poly-3-methylbutene, poly-4-methylpentene and copolymers or coextrudates thereof such as e.g. of polyethylene with vinyl acetate, acrylic acid, methacrylic acid, acrylic esters, tetrafluoroethylene or polypropylene, as well as statistical copolymers, block copolymers or olefin polymer-elastomer mixtures. HDPE and polypropylene are preferred.

Polyesters are for example polyalkylene terephthalates or polyalkylene isophthalates with alkylene groups or radicals with 2 to 10 carbon atoms or alkylene groups with 2 to 10 C atoms which are interrupted at least by one —O—, such as e.g. polyethylene terephthalate, polypropylene terephthalate, polybutylene terephthalate (polytetramethylene terephthalate), polydecamethylene terephthalate, poly-1,4-cyclohexyldimethylol terephthalate or polyethylene-2,6-naphthalene dicarboxylate or polyalkylene terephthalate and polyalkylene isophthalate copolymers, wherein the proportion of isophthalate is e.g. 1 to 10 mol %, copolymers and terpolymers, as well as block polymers and grafted modifications of the above-mentioned materials.

The ester-based thermoplastic materials polyalkylene terephthalates with alkylene groups or radicals with 2 to 10 carbon atoms and polyalkylene terephthalates with alkylene groups or radicals with 2 to 10 carbon atoms which are interrupted by one or two —O—, are advantageous.

Preferred ester-based thermoplastic materials are polyalkylene terephthalates with alkylene groups or radicals with 2 to 4 carbon atoms, and most particularly preferred are polyethylene terephthalates.

The bottom portions can be manufactured from these plastics by, for example, molding, injection molding, deep drawing or folding, and be made of, for example, polyolefins or polyesters. The bottom portions and lids can be manufactured from plastics-containing materials such as e.g. films, laminates or composite films containing the above plastics as well.

The films as such or as part of a laminate can be uniaxially or biaxially oriented.

In the case of such films, laminates or composite films, a barrier layer against gases and vapors may also be provided. Suitable are e.g. metal and ceramic barrier layers, as well as plastic barrier layers.

Metal layers are e.g. foils made of metal such as copper, tin, preferably aluminum or aluminum alloys and in particular foils made thereof in thicknesses of e.g. 3 to 400 μm, appropriately 4 to 200 μm, preferably 4 to 100 μm and in particular 8 to 20 μm.

Other barrier layers such as ceramic layers contain for example oxides from the series of silicon oxides, aluminum oxides, iron oxides, nickel oxides, chromium oxides or lead oxides or mixtures thereof. The silicon oxides or aluminum oxides are advantageous as ceramic layers. The silicon oxides can have the formula $SiO_x$, where x preferably denotes a number from 1 to 2, particularly preferably from 1.1 to 1.9 and in particular from 1.2 to 1.7. The aluminum oxides can have the formula $Al_yO_z$, where y/z denotes e.g. a number from 0.2 to 1.5 and preferably from 0.65 to 0.85.

The ceramic layer is applied for example by a vacuum thin-film technique, appropriately on the basis of electron beam evaporation or resistance heating or inductive heating from crucibles, e.g. to a plastic layer. Electron beam evaporation is preferred. The methods described can be conducted reactively and/or with ion assistance. The ceramic layer can have a thickness of 5 to 500 nm, for example.

Plastic barrier layers can for example be made of or contain polymers which are particularly gas-tight and water vapour-tight. Polyvinylidene chlorides, polyolefins, polyvinyl chlorides, acrylonitrile copolymers or biaxially oriented polyethylene terephthalate or ethylene-vinyl alcohol behave particularly favorably, for example.

The thickness of the individual plastic films in composite films or laminates can be for example 8 to 2000 μm, preferably 10 to 600 μm and in particular 12 to 25 μm.

Composite films or laminates can have the layered structures known in the art, such as e.g. containing at least two plastic layers, at least one plastic layer and at least one metal layer or containing at least one cellulose-containing layer and/or plastic layers and/or metal layers.

The bottom portions can also be made with outer layers of metal, for example aluminum, aluminum alloys, tin, tinplate and the like. In particular, the bottom portions can be made with aluminum foil, aluminum strip or aluminum thin strip by deep drawing or folding.

The bottom portions can also be made with outer layers of cellulose-containing materials such as paper, cardboard, paper-containing moulding compositions, etc.

In all embodiments, at least one printed, counterprinted or inked layer of a material such as e.g. a plastic film can be provided at least on the outside.

At least one of the layers can be insulating and made of closed-cell plastic foam such as e.g. expanded polystyrene or other materials such as e.g. crepe paper or the like.

In order to join the bottom portion to the lid, in particularly sealingly, sealable layers or sealing layers can be used. The sides of the bottom portions and/or lids facing towards the inside of the container comprise polyolefin or polyester layers. These layers may be of sealable material qualities.

Sealing layers can also be arranged between bottom portion and lid. The arrangement of such sealing layers can vary.

On the inside, at least in the edge regions or at the edge flanges and the web regions for support and sealing connection to the lid or over the whole of the inside of the bottom portion, sealing layers can be applied.

The lid can comprise a sealing layer or a layer of a sealing lacquer on the surface of the lid material which comes to lie on the inside of the container. If occasion arises, the lid material can also comprise a sealing layer or lacquer on the outside.

The sealing layer or the sealing lacquer on the inside of the lid can extend over the whole surface thereof or be present or applied only partially, in the region of the sealing to be carried out. Consequently it is possible that only the bottom portion, particularly on the side facing towards the lid, or the lid, particularly on the side facing towards the bottom portion, or both bottom portion and lid each comprise a sealing layer and/or a sealing lacquer.

The sealing layers are known in the art, and may contain or consist of for example LLDPE, LDPE, MDPE, HDPE, polypropylene, polyethylene terephthalate and heat sealing lacquers and may for example have a thickness in the range from 1 to 100 μm.

The different layers and in particular the plastic films or layers reciprocally, metal foils or layers reciprocally, ceramic layers or plastic films or layers and metal foils or layers reciprocally, can be joined together with laminating glues and/or bonding agents.

Suitable bonding agents are for example vinyl chloride copolymers, vinyl chloride-vinyl acetate copolymers, polymerizable polyesters, vinyl pyridine polymers, vinyl pyridine polymers in combination with epoxy resins, butadiene-acrylonitrile-methacrylic acid copolymers, phenolic resins, rubber derivatives, acrylic resins, acrylic resins with phenol or epoxy resins, or organo-silicon compounds such as organosilanes.

Examples of organosilanes are alkyl trialkoxysilanes with amino functional group, alkyl trialkoxysilanes with ester functional group, alkyl trialkoxysilanes with aliphatic functional group, alkyl trialkoxysilanes with glycidoxy functional group, alkyl trialkoxysilanes with methacryloxy functional group, as well as mixtures thereof. Examples of such organosilanes are γ-aminopropylene triethoxysilane and N-β-(aminoethyl-γ-aminopropyl-trimethoxysilane, γ-(3,4-epoxycyclohexyl)-ethyl trimethoxysilane, γ-glycidoxypropyl trimethoxysilane, and γ-methacryloxypropyl trimethoxysilane. These compounds are known in the art.

EAA (ethylene acrylic acid) or modified polyolefins are preferred.

Examples of modified polyolefins are acid-modified polyolefins and hence plastics formed by graft modification of a polyolefin with ethylenically unsaturated carboxylic acids or anhydrides thereof. As base polymers of polyolefins, there may be named e.g. low-density polyethylene, medium-density polyethylene, high-density polyethylene, linear low-density polyethylene, homopolypropylene, ethylene-propylene copolymers, polybutene-1, polypentene-1, butene-1-propylene copolymers and butene-1-propylene-ethylene terpolymers. Homopolypropylene and ethylene-propylene copolymers are preferred.

Examples of the ethylenically unsaturated carboxylic acids or anhydrides thereof are acrylic acid, methacrylic acid, maleic acid, fumaric acid, crotonic acid, itaconic acid, citraconic acid, 5-norbornene-2,3-dicarboxylic acid, maleic acid anhydride, citraconic acid anhydride, 5-norbornene-2,3-dicarboxylic acid anhydride and tetrahydrophthalic acid anhydride. Maleic acid anhydride is preferred here.

The preferred modified polypropylene is an adduct of maleic acid anhydride and an ethylene-propylene copolymer. Most particularly preferred are dispersions of modified polyolefins. An example of a dispersion of a modified polypropylene is Morprime (trade name of Morton Chemical Division of Norton Norwich Products, Inc.).

Other suitable bonding agents are adhesives such as nitrile rubber phenolic resins, epoxides, acrylonitrile-butadiene rubber, urethane-modified acrylic resins, polyester copolyamides, hot-melt polyesters, polyisocyanates crosslinked with hot-melt polyester, polyisobutylene-modified styrene-butadiene rubbers, urethanes, ethylene-acrylic acid copolymers and ethylene-vinyl acetate copolymers.

If laminating glues are used for example between the plastic layers, then the laminating glues can be solvent-containing or solvent-free and also water-containing. Examples are solvent-containing or aqueous acrylate glues or solvent-free polyurethane glues.

Polyurethane-based laminating glues are preferred.

The present packages also contain a lid. The lid can contain the same materials or be constructed using materials as mentioned above.

The actual bottom portions and lids can be made of the same materials and of the same design. In practice, it may also be appropriate to provide for example a rigid or semi-rigid bottom portion and to use a lid in highly flexible form, i.e. for example made as a film or film strip.

An embodiment in which both bottom portion and lid are made of a film or composite film can be selected too. Bag-like packages of this kind can confer the inherent stability which is required if really necessary, by a supporting device e.g. made of paper or cardboard.

Other embodiments can be constructed using a semi-rigid or rigid bottom portion and a semi-rigid or rigid lid.

This also allows different effects of presentation of the package, such as e.g. an opaque rigid or semi-rigid bottom portion and a transparent, if necessary soft lid.

As mentioned above, the lid can be made of different materials in different thicknesses.

Rigid or soft, deformable and at the same time in particular rollable materials are available. As an example, attention is drawn to deep-drawn or molded hard plastic lids, if occasion arises in a layered structure. Lids of this kind may contain e.g. all the above thermoplastic or other plastic materials or be made of them and for example be made of polyolefins or polyesters or contain these plastics. Analogously, these lids may contain the barrier layers described above. Other lids may be constructed from cardboard, paper or card layers which are covered with at least one metal layer and/or plastic layer. A sealing layer may be applied to one or both sides of the cardboard, paper or card layer, in particular as covering layers for the respective composite.

In particular for mechanical processing, films, composite films and laminates are available. So that these materials can be rolled up, such films, composite films and laminates are 8–1000 μm thick as a rule. Examples of them are sealable films e.g. containing or made of high-density polyethylene (HDPE), medium-density polyethylene (MDPE), polypropylene or polyethylene terephthalate, e.g. in a thickness within the range from 8 to 100 μm, advantageously 10 to 70 μm and preferably 30 to 50 μm.

Other lid materials may be composite films, constructed from the inside to the outside, if occasion arises from a sealing layer as mentioned above, a polyolefin or polyester layer, a barrier layer as mentioned above and in this case in particular a layer consisting of a foil of aluminum or an aluminum alloy in a thickness of for example 3 to 50 μm, advantageously 4 to 20 μm and particularly advantageously from 8 to 12 μm, or a film, for example a polyethylene terephthalate film, an oriented polyamide or polypropylene film or polyethylene film which is covered on at least one side with a ceramic coating, preferably a $SiO_x$ layer as described above, and if occasion arises other plastic layers or plastic laminates.

The outermost layer may in turn be a sealable layer or a dyed, printed or counterprinted layer.

The composite laminates as mentioned in the above description may be made in a manner known in the art, e.g. by coating, coextrusion coating, laminating, counter-laminating or hot calendering.

In practice, for example bottom portions which have the following structure from outside to inside are preferred: a polypropylene layer, a barrier layer of ethylvinyl alcohol and a polypropylene sealing layer, wherein the thickness of the composite can vary between 0.5 and 2 mm. The barrier layer in this composite may also consist of an aluminum foil, for example in a thickness from 20 to 10 μm, or a barrier layer of $SiO_x$ can be applied to the plastic layer of polypropylene, where x denotes a value from 1.2 to 1.7.

The lid material may be for example a lid strip formed from an outer layer of polyethylene terephthalate in a thickness from 12 to 30 μm, an aluminum foil with a thickness from 20 to 50 μm and an inner layer which is a peel layer at the same time made of polypropylene from 20 to 50 μm. Another example of a lid strip contains as an outer layer an aluminum foil from 50 to 100 μm thick and on the inside a polypropylene layer which is a peel layer at the same time, from 20 to 50 μm thick.

The above-mentioned individual layers may be joined together to form the corresponding laminates or composites in a manner known in the art, for example by means of laminating lacquers and, if occasion arises, size.

Rounds which match the bottom portion to be closed can be made from the lid materials by punching or cutting out, if occasion arises stacked and continuously or singly placed on the bottom portion and attached by heat or cold sealing, welding or glueing. The lid material may also be processed to form endless material, sheets or rolls, wherein for closing the bottom portions the lid material is continuously or stepwise sealed, welded or glued onto the bottom portion and cut out essentially according to the edge contours of the respective bottom portion.

Attachment of the lid to the respective bottom portions may be done by various methods, for example by heat or cold sealing, welding or glueing, wherein heat sealing is preferred. Furthermore, the lids may be divided into the segments in different ways.

For instance, a lid may be sealed onto the bottom portion, wherein the seal seam is sealed onto the bottom portion along the circumference of each compartment to form lid segments, and between the individual lid segments is made a weak line or division in the form of a tear or separating line of the lid material.

By another method, a lid may be sealed onto the bottom portion, wherein the seal seam is sealed onto the bottom portion along the circumference of each compartment to form lid segments, and between the individual lid segments which are formed in the process there are already weak lines or divisions in the form of tear or separating lines in the lid material.

By another method, lid segments may be sealed onto the bottom portion, wherein each lid segment covers a compartment and the lid segments are joined sealingly to the bottom portion by forming a seal seam along the circumference of each lid segment.

The lids, whether as rounds or as endless material, sheets or rolls, may be provided with weak lines or divisions in the form of tear or separating lines by mechanical, physical or chemical methods before sealing onto the respective bottom portion. The tear or separating lines in the lid should appropriately correspond to the dividing webs provided in the bottom portion, centrally and, if occasion arises, following the edge flange. The weak lines in the lid material can be obtained by partial or complete weakening along the tear or separating line provided, or partial or complete cutting through the thickness of a film. In a composite film or laminate, single layers or all layers can be weakened and/or cut. If cuts or weak lines are made in the lid material before sealing, it may be helpful to provide a supporting or gripping device on the lid material to preserve shape. The lid material which is already segmented or divided into separate parts by weak lines is temporarily mounted on this supporting or gripping device. After sealing, the temporary supporting or gripping device can easily be removed and, if occasion arises, reused. This device may be e.g. a film, a composite film or a dimensionally stable substrate.

The lid material may also first be sealed out of the plane onto the bottom portion along the edge flanges and webs, and after sealing, weak lines or divisions in the form of tear or separating lines can be made by mechanical, physical or chemical methods for example centrally of the webs and, if occasion arises, along the edge flange of the respective bottom portion.

The seal seams may be for example 1 to 6 mm, advantageously 2 to 5 mm and preferably 2.5 to 3.5 mm wide at the edge around each lid segment. The seal seams on the webs are preferably so wide that when the lid material is cut or weakened after sealing the tool tolerances of the cutting device are taken into account and each side of a seal seam divided into two has the width indicated above. In particular, double seal seams may be provided on the webs.

The weak lines or divisions can be made mechanically e.g. cutting, punching or nicking with blades, physically by e.g. heat treatment, laser radiation, electron beam radiation, electroerosion, dissolving or swelling with solvents or by chemical reaction e.g. by etching.

The separating or tear lines must be made at least so deep and wide, and tear-resistant, that at the latest on removal of the respective lid segment from the bottom portion, only the lid segment concerned is pulled off.

Particularly preferred is complete separation of the lid segments from each other, in order to prevent the pulled-off or adjacent lid segment from starting to tear.

Hence packages the lid of which is divided into the individual lid segments by weakening or cutting through the lid material are preferred, and lids which are divided into the individual lid segments by completely cutting through the lid material are particularly preferred.

A preferred package according to the present invention has, as the sealed-on lid, an embodiment in which the lid comprises for each compartment a profiled or deep-drawn lid segment, or profiled or deep-drawn individual lids are provided for each compartment. The embodiment and the processing, in particular connection to the bottom portion, are governed analogously by the above constructions.

Further preferred embodiments concern packages in which at least one lid segment is sealed on by means of a seal seam along the circumference of the compartment, and the seal seam is shaped into an initial tearing aid in the form of a curve of small radius or a spur, and the initial tearing aid is preferably located in a corner region of the respective compartment.

Other preferences concern packages in which at least one lid segment is sealed on by means of a seal seam along the circumference of the compartment and the seal seam comprises over a partial region an initial tearing aid of notch-like or arcuate incisions in the width of the seal seam. The initial tearing aids may be designed such that from the outside, from the inside or e.g. alternately from the outside and inside of the seal seam, notch-like or arcuate recesses in a portion of the width of the seal seam are not sealed over a relatively short length, e.g. 1 to 5 cm. This measure is obtained by correspondingly shaped sealing tools.

The initial tearing aids may be located in a corner or centrally of the outer edge of a compartment, or the initial tearing aids may be located for example in the region between two or more lid segments. Packages according to the present invention, wherein the sealed-on lid contains a tear-off tab on at least one lid segment, preferably in the region of an initial tearing aid, are advantageous too.

Where there is an initial tearing spur, arrangement of the tear-off tab in the region and perpendicularly to the initial tearing spur is preferred. The tear-off tabs may also be designed in such a way that the bottom portion comprises a countertab opposite the tear-off tab of the lid segment. With tear-off tab and countertab, easy handling is obtained when the containers are opened. Instead of tabs, handles or ring pulls can be provided.

The seal seams can be applied in a manner known in the art. Sealing can be done by heat, high-frequency radiation or ultrasound and by means of sealing tools. Typical sealing temperatures are from 100° to 300° C. and advantageously from 150° to 250° C. The pressure of the sealing tools may be for example from 10 to 400 kg/cm$^2$ and advantageously from 40 to 150 kg/cm$^2$. The sealing times may be from 0.2 to 3 s and advantageously from 0.4 to 2 s. The seal seams applied under these conditions can easily be pulled or peeled off, forming a cohesion or adhesion rupture. It may also be provided that by applying the weak lines or separating lines and/or seal seams of different strengths, the lid segments cannot be peeled or pulled off completely. As a result the lid segments of the individual compartments expose the compartment and its contents, but still adhere to the bottom portion by a portion of the seal seam. Thus in particular a waste problem, namely that the lid segments are thrown away individually, can be reduced or the compartments can be reclosed.

The figures below illustrate the present invention in more detail.

Figure 1:
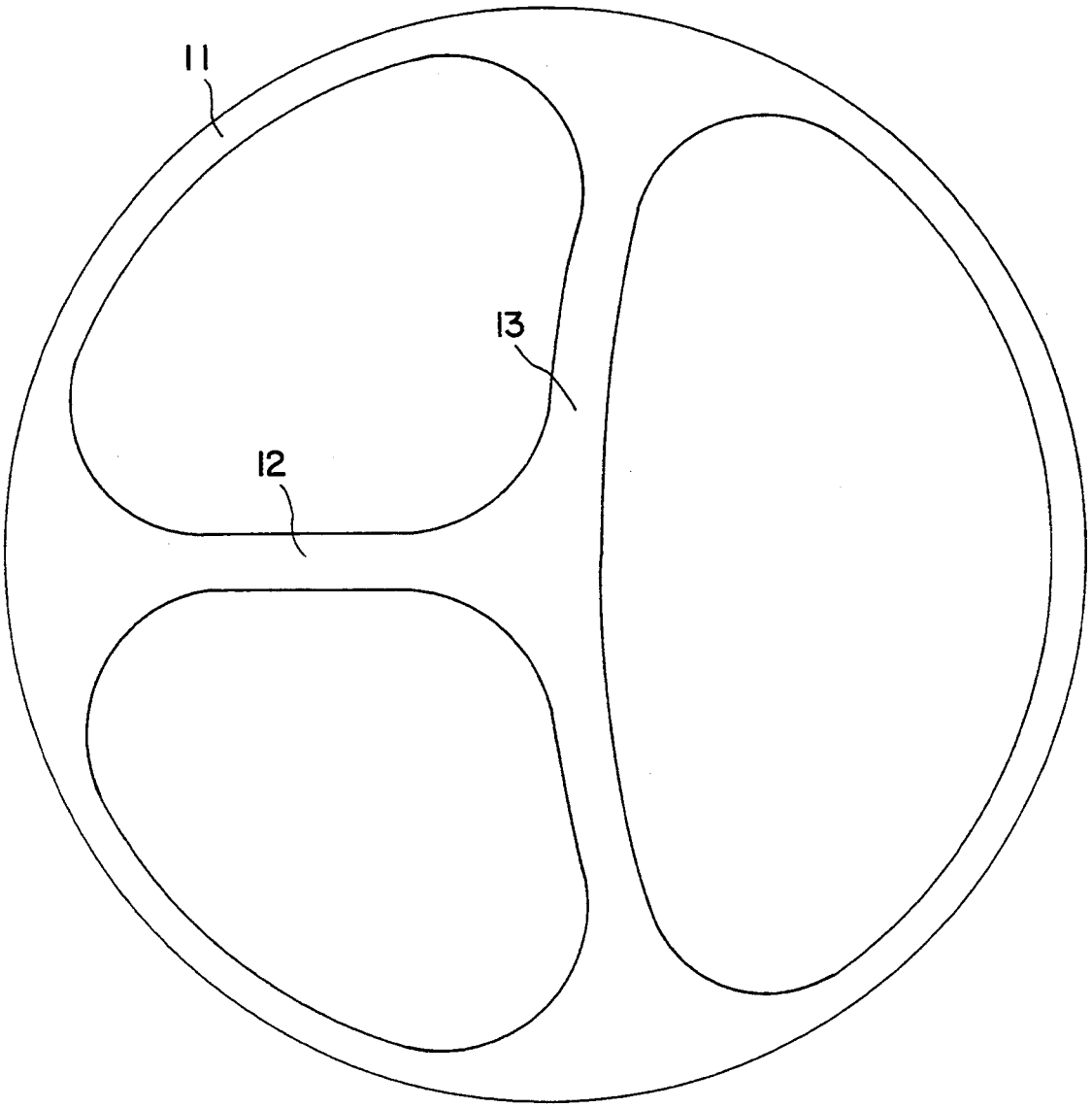
FIG. 1 shows a plan view of a bottom portion selected as an example, with a round shape with three compartments (three-compartment tray).

According to FIG. 1, the edge flange (11) defines the bottom portion, and the bottom portion is divided by the webs (12, 13) into a three-compartment tray.

Figure 2:
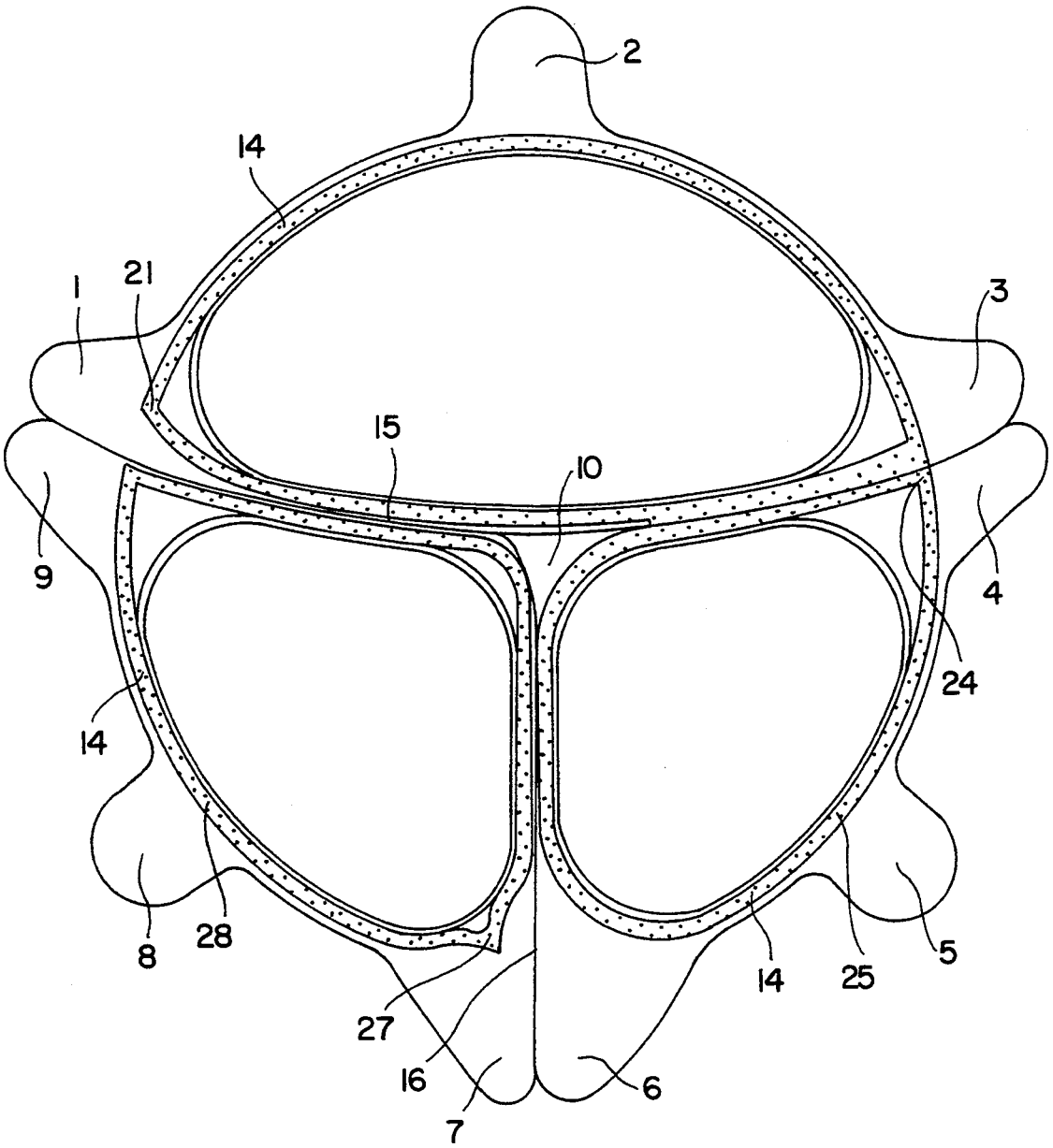
FIG. 2 shows the plan view of a lid constructed by way of example for use on a bottom portion according to FIG. 1.

In FIG. 2 is drawn the corresponding lid. The hatched areas (14) show the seal seams. As an example, (1) to (10) indicate positions at which tear-off tabs or tear-open strips can be arranged. The positions are examples, and in practice only one tear-off tab and tear-open strip, and possibly also a holding strip, are provided for each lid segment as a rule. The tear-off tabs (1, 4 and 7) are the preferred locations, because small peel-off forces are necessary there due to small radii (24) of the seal seams or initial tearing spurs (21, 27). The positions (2, 5) and (8) show useful, but not optimum positions. The positions (6) and (9) show similarly suitable positions for tear-off tabs or tear-open strips. Preferably for handling are, for example, positions (1) and (4) or (3) and (9), in order to be able to pull off the lid segments relative to each other. The arrangement of a tear-off tab or tear-open strip at position (10) shows one possible way to dispense with one or more edge-located tear-open tabs or tear-open strips. This may be valuable from practical or aesthetic considerations. It is also possible to make the position (10) so large, wherein the web of the bottom portion therebeneath must be made correspondingly large, that the tear-open tabs or tear-open strips of each compartment can be provided at position (10).

Further, initial tearing aids (25, 28) are shown by way of example in FIG. 2. The initial tearing aid (25) comprises notch-like recesses arranged on one side in the width of the seal seam, and in case of initial tearing aid (28) recesses arranged on both sides in the width of the seal seam. The separating or tear lines (15, 16) which divide or separate the lid into the lid segments extend in the web regions appropriately centrally of the seal seam or the double seal seam.

In the other embodiments, tear-off tabs and tear-open strips are synonyms.

Figure 3:
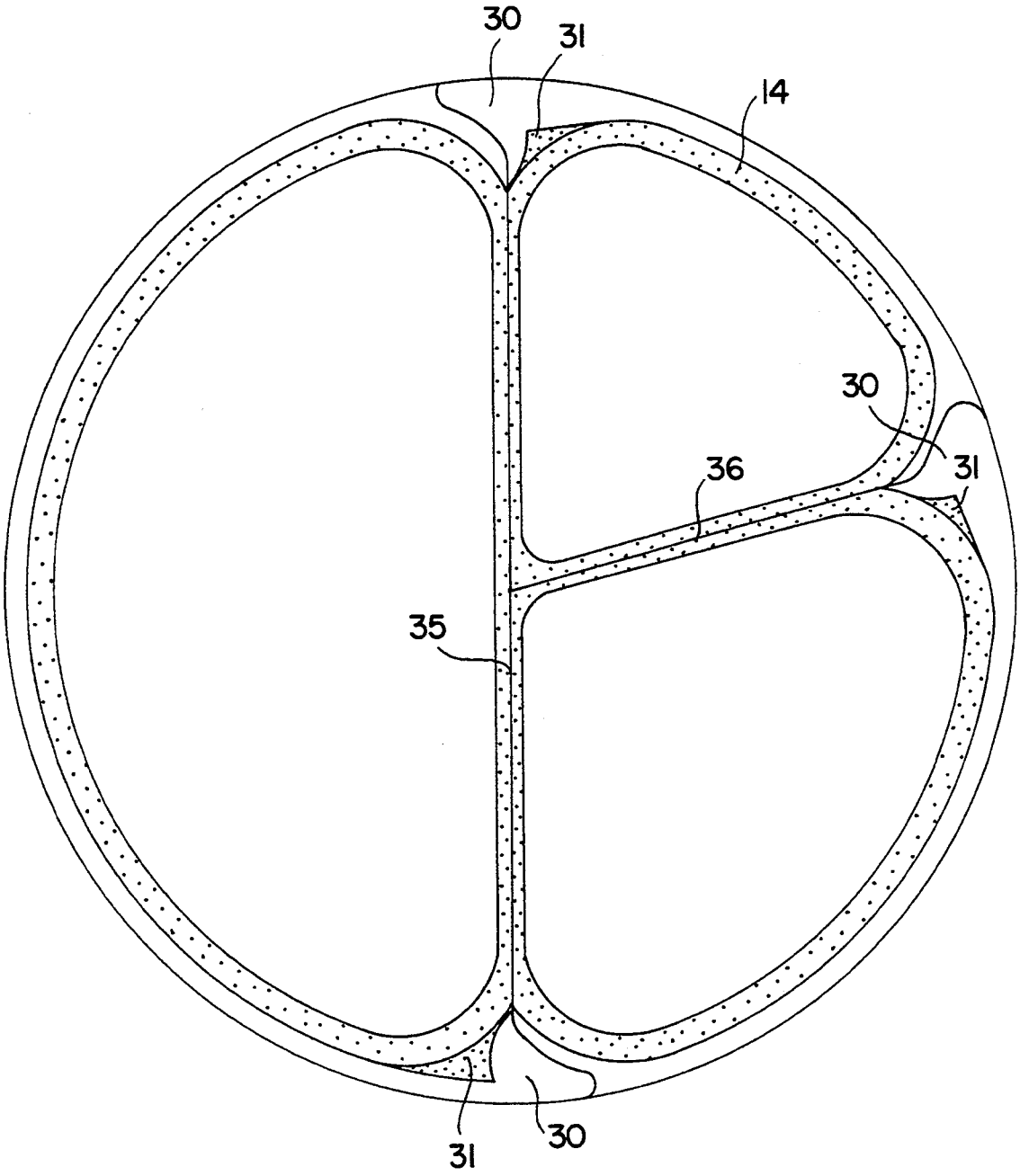
FIGS. 3 to 6 show plan views of other lids constructed by way of example for use on different bottom portions.

FIG. 3 shows a plan view of a lid constructed as an example for a three-compartment container.

The hatched areas (14) show the seal seams. The lids can be opened by means of the tear-off tabs (30) from the region of the initial tearing spurs (31). The tear-off tabs are designed so that they do not protrude beyond the outer circumference of the container. The separating or tear lines (35, 36) divide the lid into lid segments.

Figure 4:
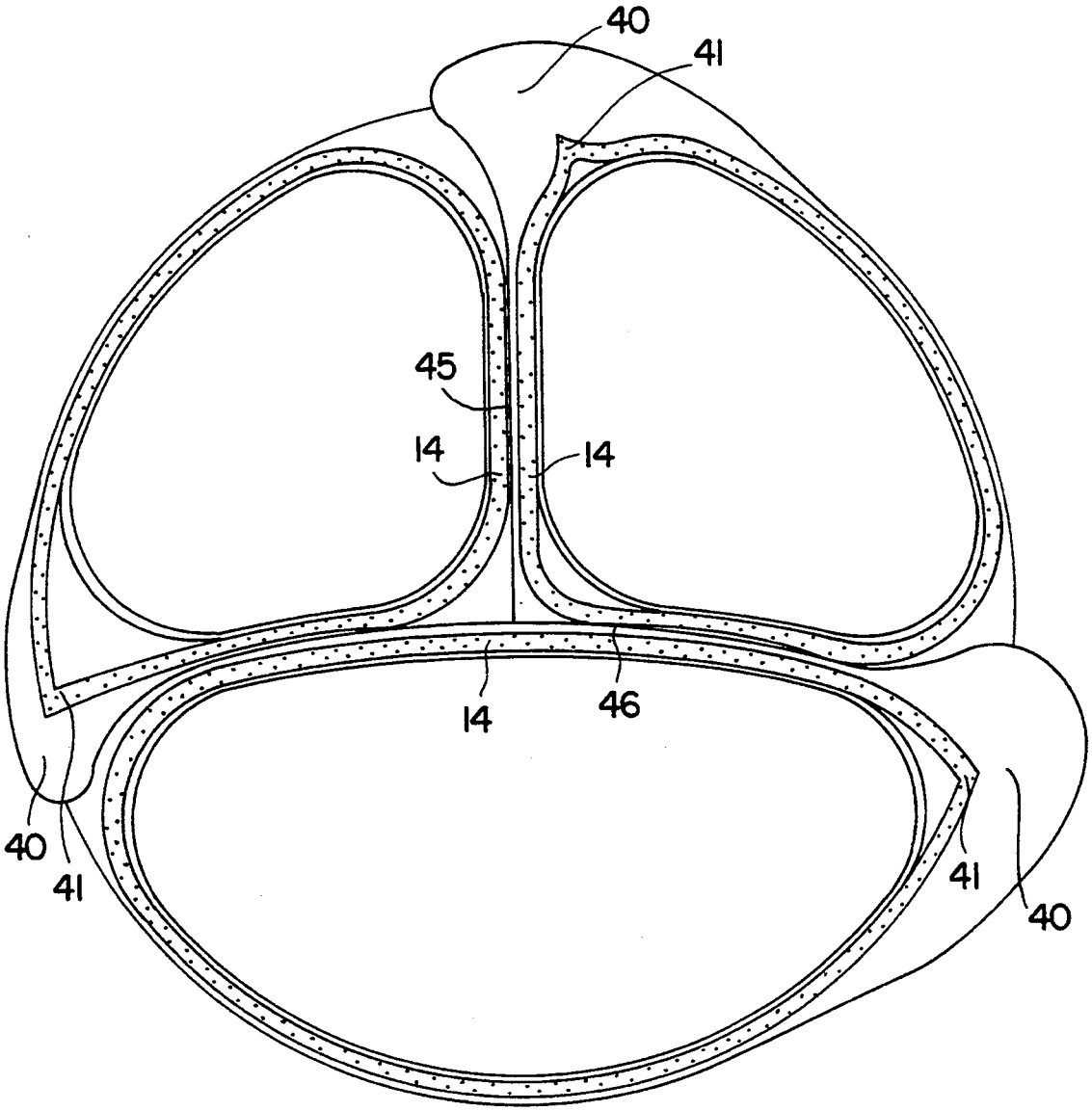

FIG. 4 shows a plan view of a lid which as an example is divided into three lid segments for covering a three-compartment tray. The hatched areas (14) denote the seal seams, and the separating or tear lines (45, 46) indicate the contours of the lid segments. Different tear-off tabs (40) and initial tearing spurs (41) are shown as examples.

Figure 5:
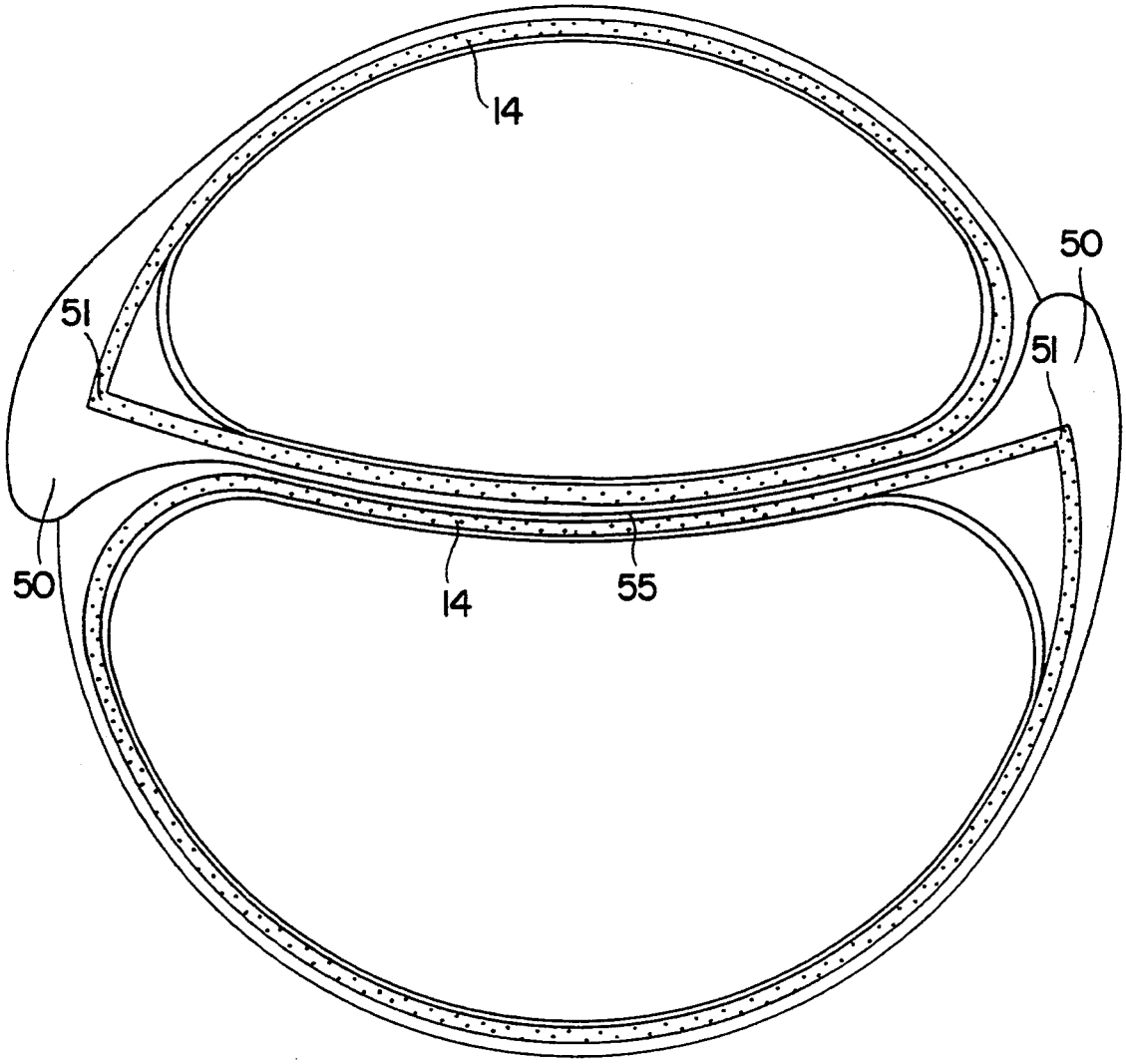

FIG. 5 shows a plan view of a lid which as an example is divided into two lid segments for covering a two-compartment tray.

The separating line or tear line (55) divides the lid into two segments. The hatched areas (14) denote the seal seams. The lid segments can be pulled off the bottom portion of the container independently of each other by means of the tear tabs (50). To make pulling off (peeling) easier, initial tearing spurs (51) are provided for each tear-off tab (50).

Figure 6:
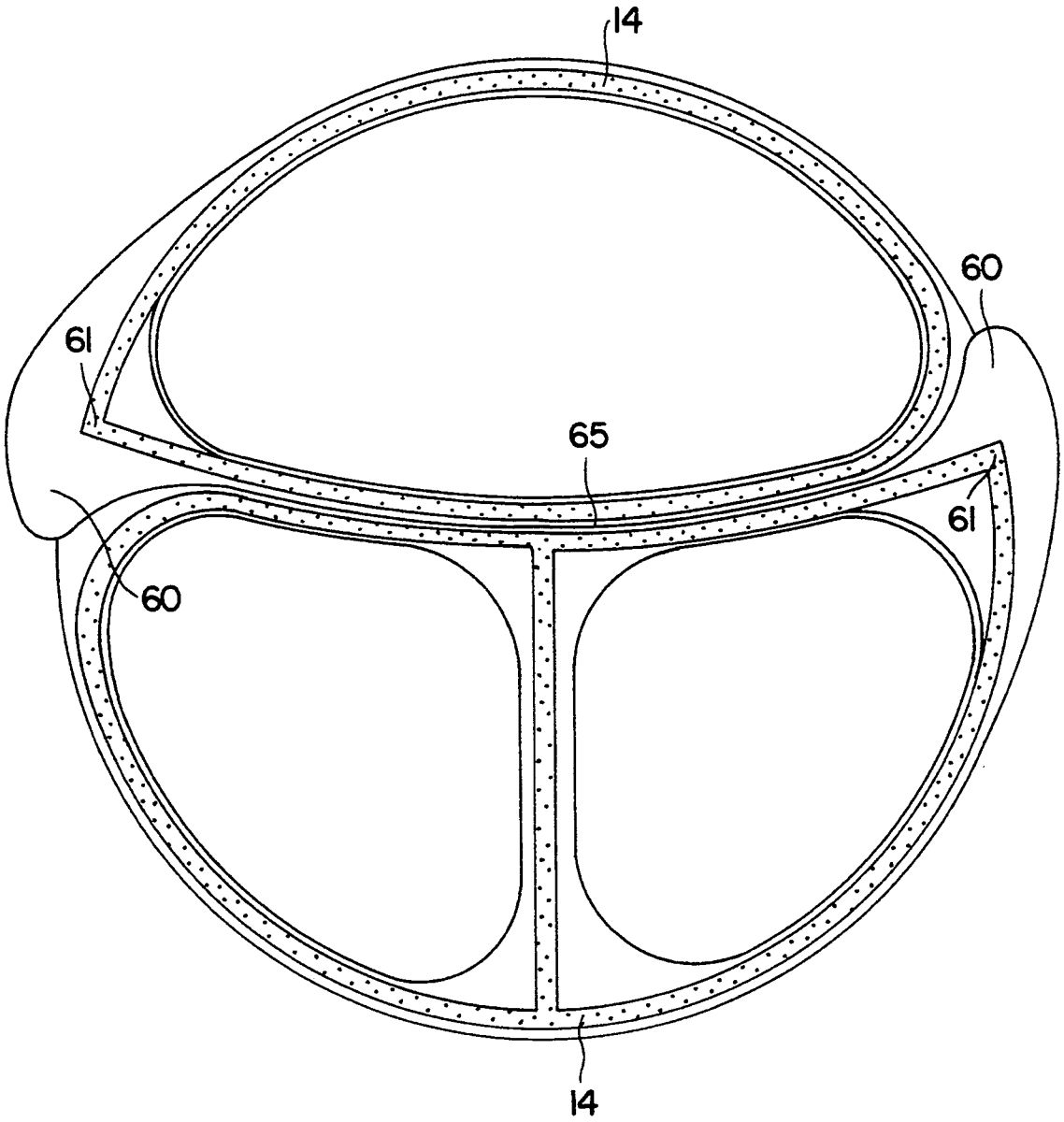

FIG. 6 shows the plan view of a lid which as an example is divided into two lid segments, but covers a three-compartment tray. According to the hatched areas (14), each of the three compartments is sealed independently by the seal seams indicated thereby. By removing the lid segments by means of tear-off tabs (60) and initial tearing spurs (61) along the separating line (65), in one case one compartment is exposed, and in the other case two compartments are exposed.

The present invention also concerns the use of packages according to the invention for holding different filler materials in separate compartments and for separate removal of the different filler materials.

The package is suitable for holding all manner of filler materials, but in particular for holding foodstuffs. The foodstuffs can be put in raw or in a form ready for consumption. After filling and before or after sealing on the lid, the package is sterilized, for example within the range of standard sterilizing conditions at 121°–130° C., 2.2–3.5 bar and for 30 seconds to 30 min. The filled package can be stored at room temperature, refrigerated or frozen and heated before use, e.g. heated in a water bath or to boiling temperature. To remove the filler materials, each lid segment can be opened independently, e.g. in accordance with the sequence of removal.

Other applications are e.g. packages for consumption of portions or assortment packages.

EXAMPLE

A bottom portion as shown in FIG. 1 consisting of a polypropylene tray with webs 10 mm wide and an edge flange 5 mm wide is filled with filler material, and a lid consisting of a polypropylene-aluminum composite is sealed on at 220° C., 6 bar pressure (40 kg/cm$^2$) for 0.75 s.

The sealed container is sterilized for 30 min at 121° C. and 2.2 bar counterpressure. Then, with a peel-off angle of 135° and a test speed of 100 mm/min, the peel-off forces and further tearing forces are determined at the tear-off tabs or tear-open strips in the positions (1 to 10) according to FIG. 2. The rupture pattern shows a uniform cohesion rupture.

The measured values are listed in Table 1.

TABLE 1

| Tear-off tab | Initial tearing force [N] | Further tearing force [N] |
|---|---|---|
| 1 | 17.5 | 12.0 |
| 2 | 47.0 | — |
| 3 | 18.5 | 13.0 |
| 4 | 16.0 | 12.0 |
| 5 | 41.0 | — |
| 6 | 19.0 | — |
| 7 | 28.0 | 10.0 |
| 8 | 36.0 | — |
| 9 | 16.0 | 12.5 |
| 10 | 31.0 | 13.0 |

The rupture pattern shows in all cases a uniform, neat cohesion rupture.

We claim:

1. Package which comprises: a bottom portion having at least two compartments, with each compartment having compartment edges and a compartment circumference, wherein the bottom portion is a single unitary bottom portion with non-separable compartments interconnected along said bottom portion, and a peel-off lid having an outer circumference and mounted on the compartment edges, said lid divided into lid segments, with each lid segment covering at least one compartment and each lid segment being sealed onto the bottom portion along the compartment circumference by a seal seam, with the lid divided into individual lid segments by weakening adjacent the seal seam, and wherein each lid segment can be at least partially peeled by the seal seam along the compartment circumference and at least partially pulled off separately from the other lid segments by said weakening, wherein the package in plan view has a shape selected from the group consisting of round and oval, and each lid segment contains a tear-off tab, and wherein the package is sterilizable and the bottom portion and the lid comprise a layer selected from the group consisting of polyolefin and polyester, at least on the side facing towards the inside of the container, wherein the seal seam includes an initial tearing aid in the form selected from the group consisting of a curve of small radius and a spur adjacent the tear-off tab and wherein the tear-off tab is spaced from a compartment and adjacent the outer circumference of the lid, whereby each lid segment can be at least partially peeled and pulled off separate from the other lid segments by the seal seam and weakening by means of the tear-off tab and initial tearing aid.

2. Package according to claim 1 having 2–4 compartments.

3. Package according to claim 1 wherein said tearing aid is located in a corner region of the respective compartment.

4. Package according to claim 1, wherein at least one lid segment is sealed on by means of a seal seam along the compartment circumference, and the seal seam comprises over a partial region an initial tearing aid in the form of arcuate incisions in the seal seam.

5. Package according to claim 1 wherein the lid is divided into the individual lid segments by cutting through the lid material.

6. Package according to claim 1 wherein the sealed-on lid consists of a strip-like film or laminate.

7. Package according to claim 1 wherein the bottom portion and the lid comprise a layer selected from the group consisting of high-density polyethylene (HDPE), polypropylene, and polyalkylene terephthalate, on the side facing towards the inside of the container.

8. Package according to claim 7 wherein the layer selected from the group consisting of high-density polyethylene, polypropylene and polyalkylene terephthalate, is sealable.

9. Packages according to claim 1 for holding different filler materials in separate compartments and for separate removal of the different filler materials.

10. Package according to claim 1 including a tear-off tab for each compartment.

11. Package according to claim 1 wherein the tear-off tab is above and to the side of a compartment.

12. Package according to claim 1 wherein the seal seam is from 1 to 6 mm.

13. Package according to claim 1 wherein at least two of said tear-off tabs are opposite each other to permit easy handling of the respective tear-off tabs.

14. Package according to claim 1 wherein the seal seam is continuous along the periphery of each compartment and wherein the tearing aid extends from said continuous seal seam towards said tear-off tab.

15. Package according to claim 5 including tear lines in each lid segment adjacent each seal seam to separate the lid segments from each other.

16. Package which comprises: a bottom portion having at least two compartments, with each compartment having compartment edges and a compartment circumference, and a peel-off lid having an outer circumference and mounted on the compartment edges, said lid divided into lid segments, with each lid segment covering at least one compartment and each lid segment being sealed onto the bottom portion along the compartment circumference by a seal seam, with the lid divided into individual lid segments by weakening adjacent the seal seam, and wherein each lid segment can be at least partially peeled by the seal seam along the compartment circumference and at least partially pulled off separately from the other lid segments by said weakening, wherein the package in plan view has a has a shape selected from the group consisting of round and oval, and each lid segment contains a tear-off tab, and wherein the package is sterilizable and the bottom portion and the lid comprises a layer selected from the group consisting of polyolefin and polyester, at least on the side facing towards the inside of the container, wherein the seal seam includes an initial tearing aid in the form selected from the group consisting of a curve of small radius and a spur adjacent the tear-off tab and wherein the tear-off tab is spaced from a compartment and adjacent the outer circumference of the lid, and wherein the sealed-on lid consists of a lid segment deep-drawn for each compartment, whereby each lid segment can be at least partially peeled and pulled off separate from the other lid segments by the seal seam and weakening by means of the tear-off tab and initial tearing aid.

17. Package according to claim 16 including deep-drawn individual lids for each compartment.

* * * * *